US008405451B2

(12) United States Patent
Fukami

(10) Patent No.: US 8,405,451 B2
(45) Date of Patent: Mar. 26, 2013

(54) CURRENT SOURCE CIRCUIT AND SEMICONDUCTOR DEVICE

(75) Inventor: Ikuo Fukami, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 143 days.

(21) Appl. No.: 13/041,069

(22) Filed: Mar. 4, 2011

(65) Prior Publication Data

US 2011/0215859 A1 Sep. 8, 2011

(30) Foreign Application Priority Data

Mar. 5, 2010 (JP) ..... 2010-049009

(51) Int. Cl.
*G05F 1/10* (2006.01)

(52) U.S. Cl. ..... 327/543

(58) Field of Classification Search ..... 327/513, 327/538, 539, 543
See application file for complete search history.

(56) References Cited

U.S. PATENT DOCUMENTS 6,783,274 B2 * 8/2004 Umeyama et al. ..... 374/178
6,894,473 B1 * 5/2005 Le et al. ..... 323/314
6,901,022 B2 * 5/2005 Fiscus ..... 365/222
7,973,593 B2 * 7/2011 Kitamura ..... 327/539
2008/0048771 A1 2/2008 Watanabe

FOREIGN PATENT DOCUMENTS

JP 2008-52639 A 3/2008

* cited by examiner

*Primary Examiner* — Jeffrey Zweizig
(74) *Attorney, Agent, or Firm* — Sughrue Mion, PLLC

(57) ABSTRACT

A current source circuit includes a reference current source circuit; a reference voltage source circuit generating a voltage proportional to a thermal voltage based on the reference current; a first transistor connected between the reference voltage source circuit and the second power supply voltage and through which a first current flows; a second transistor which has a gate applied with a voltage as a result of addition of the voltage generated by the reference voltage source circuit and a voltage between a source and a drain of the first transistor and through which a second current flows; a current source supplying a third current of a current value proportional to that of the first current; and a third transistor through which a difference current between the second current and the third current flows. An output current is supplied based on the difference current.

8 Claims, 6 Drawing Sheets

CURRENT SOURCE CIRCUIT AND SEMICONDUCTOR DEVICE

INCORPORATION BY REFERENCE

This patent application claims a priority on convention based on Japanese Patent Application No. 2010-49009 filed on Mar. 5, 2010. The disclosure thereof is incorporated herein by reference.

TECHNICAL FIELD

The present invention relates to a current source circuit and a semiconductor device in which the current source circuit is formed.

BACKGROUND ART

In a semiconductor integration circuit, it has been difficult to obtain a stable current against a process variation, a power supply voltage variation, and a temperature variation in a simple circuit configuration. For example, as shown in FIG. 1, a constant current circuit disclosed in Patent Literature 1 (JP 2008-052639A) includes a band gap reference circuit 1, a current outputting circuit 2, an inverting circuit 3, and a level shifter 4. The band gap reference circuit 1 includes PMOS transistors P1 and P2, NMOS transistors N1 to N3, a resistance R1, and diodes D1 and D2. The NMOS transistor N3 serves as a variable resistance for feedback. The level shifter 4 includes PMOS transistors P3 and P4. The inverting circuit 3 includes PMOS transistors P5 and P6, and an NMOS transistor N4. The inverting circuit 3 serves as an error amplifying circuit. The current outputting section 2 includes a PMOS transistor P7.

When the value of the resistance R1 varies due to the process variation, the resistance value of the NMOS transistor N3 serving as the variable resistance for feedback is changed by the inverting circuit 3 serving as the error amplifying circuit, to suppress a variation of an output current I4 from the output transistor P7. Here, a basic current of the current I4 flowing through the output transistor P7 is given by the following equation (1):

$$I_4 = m\frac{kT}{qR_1} \tag{1}$$

where m is a constant (uniquely determined based on a mirror ratio of P1 to P2, and an area ratio of D1 to D2), k is the Boltzmann constant ($1.38\times10^{-23}$ [J/K]), T is an absolute temperature [K], q is elementary charge ($1.602\times10^{-19}$ [C]), and $R_1$ is the value of the resistance R1 [•].

Here, the resistance R1 is required to have a temperature characteristic proportional to the absolute temperature T to reduce a temperature dependency of the current I4. That is, since a condition that "$T/R_1$" in the equation (1) is constant needs to be satisfied to reduce the temperature dependency, the semiconductor manufacturing process is restricted.

In addition, operation points of the inverting circuit 3 serving as the error amplifying circuit and of the NMOS transistor N3 serving as the variable resistance for feedback are difficult to be set and, therefore, the operation points easily vary due to the variation of transistors and the like. Accordingly, the amount of feedback is not stable. Here, it should be noted that the term of "kT/q" in the equation (1) is called a thermal voltage in the semiconductor engineering. The thermal voltage is proportional to the absolute temperature T, and has the following voltage values at the respective temperatures:

−40 [° C.] (233 [K]) 20 [mV]
+27 [° C.] (300 [K]) 26 [mV]
+150 [° C.] (423[K]) 36 [mV]

CITATION LIST

[Patent Literature 1]: JP 2008-052639A

SUMMARY OF THE INVENTION

The present invention provides a current source circuit which supplies a stable current in a simple circuit configuration, and a semiconductor device in which the current source circuit is formed.

In an aspect of the present invention, a current source circuit includes: a reference current source circuit configured to generate a reference current based on a first power supply voltage and a second power supply voltage; a reference voltage source circuit configured to generate a voltage proportional to a thermal voltage based on the reference current; a first transistor of a first conductive type which is connected between the reference voltage source circuit and the second power supply voltage and through which a first current flows; a second transistor of the first conductive type which has a gate applied with a voltage as a result of addition of the voltage generated by the reference voltage source circuit and a voltage between a source and a drain of the first transistor and through which a second current flows; a current source configured to supply a third current of a current value proportional to that of the first current; and a third transistor of a second conductive type complimentary to the first conductive type. The difference current between the second current and the third current flows through the third transistor. An output current is supplied based on the difference current.

According to the present invention, the current source circuit and the semiconductor device with the current source circuit incorporated therein can be provided to supply the stable current in the simple circuit configuration.

BRIEF DESCRIPTION OF THE DRAWINGS

The above and other objects, advantages and features of the present invention will be more apparent from the following description of certain embodiments taken in conjunction with the accompanying drawings, in which.

DESCRIPTION OF EMBODIMENTS

Figure 1:
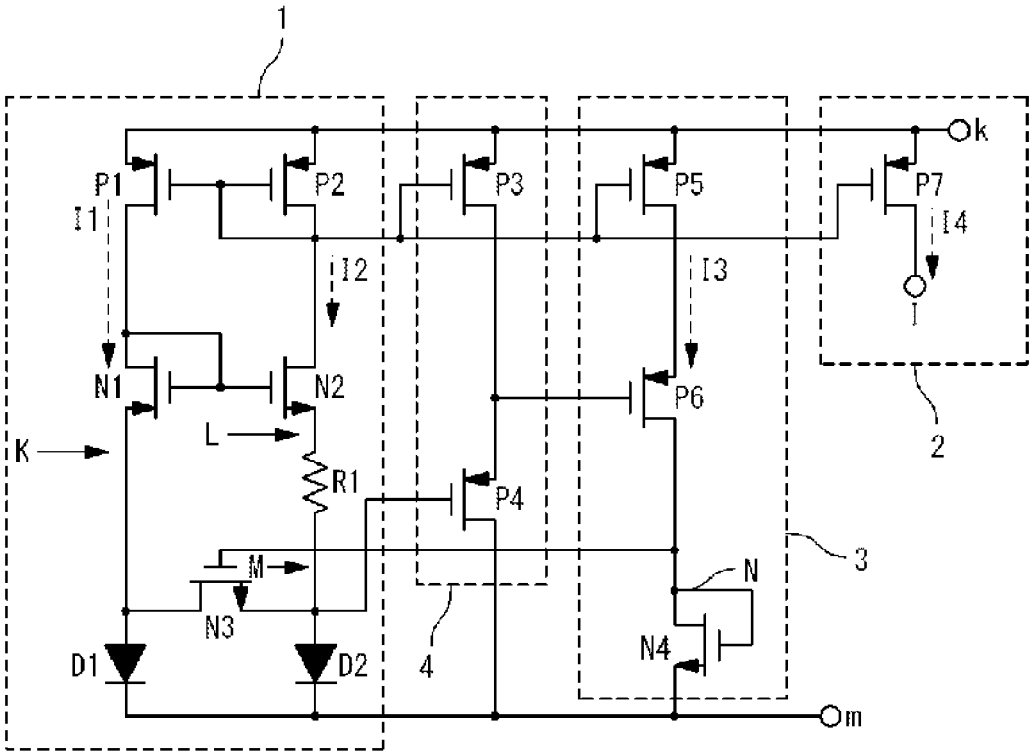
Fig. 1 CONVENTIONAL ART
FIG. 1 is a circuit diagram showing a configuration of a conventional constant current circuit.

The present invention provides a stable constant current by changing from a basic current determined due to a resistance to a basic current determined due to a transistor to be described below and by employing a circuit configuration by which a process variation, a power supply variation, and a temperature variation are cancelled. Here, the basic current determined based on a resistance is expressed by the following equation:

$$I = \frac{V}{R}$$

where V is a voltage applied to a resistance, and R is a resistance value.

In addition, the basic current determined due to a transistor is expressed by the following equation (2):

$$I = \frac{\beta}{2}\frac{W}{L}(V_{eff})^2 \tag{2}$$

where • is a conductance constant of the transistor, W is the gate width of the transistor, L is the gate length of the transistor, and Veff is an overdrive voltage of the transistor.

By the way, the basic current equation in the transistor is well known in the following equation (3):

$$I = \frac{\beta}{2}\left(\frac{W}{L}\right)(Vgs - Vtn)^2 \tag{3}$$

where Vgs is a voltage between a gate and a source in the transistor, and Vtn is a threshold voltage of the transistor.

Namely, a relation with the overdrive voltage is shown as follows:

$$Veff = Vgs - Vtn.$$

For example, when Vgs is 5[V] (Vgs=5[V]) and Vtn is 1[V] (Vtn=1[V]), the overdrive voltage Veff is 4[V] (Veff=Vgs−Vtn=5-1=4[V]). In the present embodiment, since a method for cancelling the threshold voltage Vtn of the transistor by a circuit technique is employed, the description is given by using the overdrive voltage.

First Embodiment

Referring to the drawings, a first embodiment of the present invention will be described.

Figure 2:
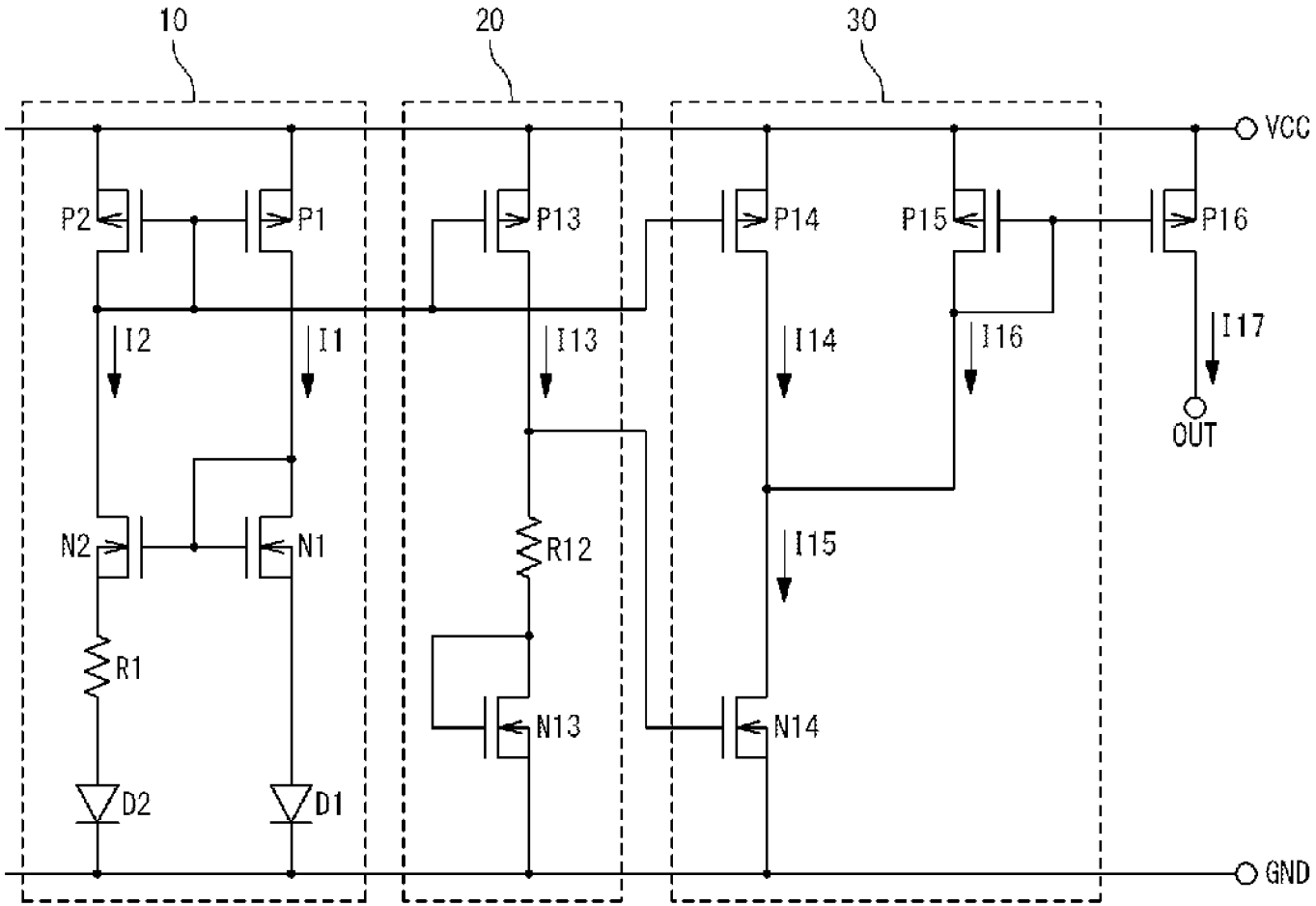
FIG. 2 is a circuit diagram showing a configuration of a current source circuit according to a first embodiment of the present invention.

FIG. 2 shows a configuration of a current source circuit according to the first embodiment of the present invention. The current source circuit includes a band gap reference circuit 10, a gate voltage generating circuit 20, a current correcting circuit 30, and an output transistor P16.

The band gap reference circuit 10 includes P-channel MOS transistors P1 and P2, N-channel MOS transistors N1 and N2, a resistance R1, and diodes D1 and D2. The transistors P1 and P2 form a current mirror circuit. The commonly-connected gates are connected to a drain of the transistor P2. Thus, the transistor P2 serves as an input-side transistor and the transistor P1 serves as an output-side transistor. When a current mirror ratio of the current mirror circuit formed from the transistors P1 and P2 is 1:1 and when a current I1 flows through the transistor P1 and a current I2 flows through the transistor P2, $I_1$ is equal to $I_2$ ($I_1=I_2$).

A drain of the transistor P1 is connected to a drain of the transistor N1, and the drain of the transistor P2 is connected to a drain of the transistor N2. The transistors N1 and N2 form a current mirror circuit. The commonly-connected gates are connected to the drain of the transistor N1. Thus, the transistor N1 serves as an input-side transistor and the transistor N2 serves as an output-side transistor. A source of the transistor N1 is connected to a power supply voltage GND through the diode D1. A source of the transistor N2 is connected to the power supply voltage GND through the resistance R1 and the diode D2 that are connected in series. The area ratio of the diodes D1 and D2 is set to 1:10.

The gate voltage generating circuit 20 includes a P-channel MOS transistor P13, an N-channel MOS transistor N13, and a resistance R12. The transistor P13 serves as an output-side transistor of the current mirror circuit by using the transistor P2 of the band gap reference circuit 10 as the input-side transistor. When a current ratio of the current mirror circuit is 1:1 and when a current flowing through the transistor P13 is $I_{13}$, $I_2$ is equal to $I_{13}$ ($I_2=I_{13}$). A drain of the transistor P13 is connected to the power supply voltage GND through a series connection of the resistance R12 and the transistor N13 which is diode-connected. A voltage of a connection node between the transistor P13 and the resistance R12 is supplied to the current correcting circuit 30.

The current correcting circuit 30 includes P-channel MOS transistors P14 and P15 and an N-channel MOS transistor N14. The transistor P14 serves as an output-side transistor of the current mirror circuit by using the transistor P2 of the band gap reference circuit 10 as the input-side transistor. When a current ratio of the current mirror circuit is 1:3.74 and when a current flowing through the transistor P14 is $I_{14}$, $I_{14}$ is equal to $3.74\times I_2$ ($I_{14}=3.74\times I_2$). The transistor P15 is connected to a gate of the transistor P16 at its drain and gate, and serves as an input-side transistor of the current mirror circuit by using a transistor P16 as an output-side transistor. The drain of the transistor P15 is connected to the drain of the transistor P14 and is further connected to the power supply voltage GND through the transistor N14. The gate of the transistor N14 is connected to the connection node of the gate voltage generating circuit 20 between the drain of the transistor P13 and the resistance R12.

The output transistor P16 has a gate connected to the gate of the transistor P15, a source connected to the power supply voltage VCC, and supplies a current I17 from a drain as an output node OUT.

An operation of the current source circuit will be described. In the band gap reference circuit 10, the area ratio of the diodes D1 and D2 is set to 1:10, and the current mirror ratio of the transistors P1 and P2 is set to 1:1, and the transistors N1 and N2 are set to the same size. In this case, when voltage drops by the diodes D1 and D2 are $V_{D1}$ and $V_{D2}$, the voltage drop $V_{R1}$ due to the resistance R1 is obtained from the following equation (4):

$$\begin{aligned} V_{R1} &= V_{D1} - V_{D2} \\ &= \frac{kT}{q}\ln\left(\frac{I_1}{I_{S1}}\right) - \frac{kT}{q}\ln\left(\frac{I_2}{I_{S2}}\right) \\ &= \frac{kT}{q}\ln\left(\frac{I_1}{I_2}\frac{I_{S2}}{I_{S1}}\right) = \frac{kT}{q}\ln(10) \end{aligned} \tag{4}$$

where $V_{R1}$ is the voltage drop due to the resistance R1, $V_{D1}$ is the voltage drop due to the diode D1, $V_{D2}$ is a voltage drop due to the diode D2, $I_{S1}$ is an inverse direction saturation current of the diode D1, $I_{S2}$ is an inverse direction saturation current of the diode D2, $I_1/I_2$ (=1, 1:1) is a current mirror ratio of the transistors P1 and P2, and $I_{S2}/I_{S1}$ (=10, 10:1) is a diode area ratio.

Accordingly, the current $I_2$ can be obtained from the following equation (5):

$$I_2 = \frac{V_{R1}}{R_1} = \frac{kT}{qR_1}\ln(10) \tag{5}$$

In addition, if the transistors P1, P2, and P13 that constitute a current mirror circuit have a same size, a relation between the currents $I_1$, $I_2$, and $I_{13}$ flowing through the transistors P1, P2, and P13 is shown as follows:

$$I_1=I_2=I_{13}$$

Moreover, the gate voltage generating circuit 20 applies a voltage $V_{G4}$ of the connection node between the transistor P13 and the resistance R12 to the gate of the transistor N14. Specifically, the voltage $V_{G4}$ that is a summation of the voltage drop $V_{N13}$ due to the transistor N13; and the voltage drop $V_{R12}$ due to the resistance R12 is applied to the gate of the transistor N14. As could be understood from the following equations (6), the voltage drop $V_{R12}$ due to the resistance R12 is proportional to the thermal voltage:

$$V_{N13} = \sqrt{\frac{I_{13}}{\frac{\beta}{2}\left(\frac{W_{13}}{L_{13}}\right)}} + V_{tn} = \sqrt{\frac{I_2}{\frac{\beta}{2}\left(\frac{W_{13}}{L_{13}}\right)}} + V_{tn} \tag{6}$$

$$V_{R12} = I_{13} \times R_{12} = I_2 \times R_{12} = \frac{R_{12}}{R_1}\frac{kT}{q}\ln(10)$$

$$V_{G4} = V_{N13} + V_{R12} = \sqrt{\frac{I_2}{\frac{\beta}{2}\left(\frac{W_{13}}{L_{13}}\right)}} + V_{tn} + \frac{R_2}{R_1}\frac{kT}{q}\ln(10)$$

where $W_{13}$ is a gate width of the transistor N13, $L_{13}$ is a gate length of the transistor N13, and Vtn is a threshold voltage of the N-channel transistor.

Thus, a current $I_{15}$ shown by the following equation (7) flows though the transistor N14 of the current correcting circuit 30:

$$\begin{aligned} I_{15} &= \frac{\beta}{2}\left(\frac{W_{14}}{L_{14}}\right)(V_{G4} - V_{tn})^2 \\ &= \frac{\beta}{2}\left(\frac{W_{14}}{L_{14}}\right)\left(\sqrt{\frac{I_2}{\frac{\beta}{2}\left(\frac{W_{13}}{L_{13}}\right)}} + V_{tn} + \frac{R_{12}}{R_1}\frac{kT}{q}\ln(10) - V_{tn}\right)^2 \\ &= \frac{\beta}{2}\left(\frac{W_{14}}{L_{14}}\right)\left(\sqrt{\frac{I_2}{\frac{\beta}{2}\left(\frac{W_{13}}{L_{13}}\right)}} + \frac{R_{12}}{R_1}\frac{kT}{q}\ln(10)\right)^2 \end{aligned} \tag{7}$$

where $W_{14}$ is a gate width of the transistor N14, and $L_{14}$ is a gate length of the transistor N14.

The equation (7) does not include the threshold voltage Vtn of the N-channel transistor, and the power supply voltage Vcc. That is, the current I15 flowing through the transistor N14 becomes a stable current which does not receive the influences of a variation of the threshold voltage of the transistor, and a variation of the power supply voltage of the circuit.

Figure 3:
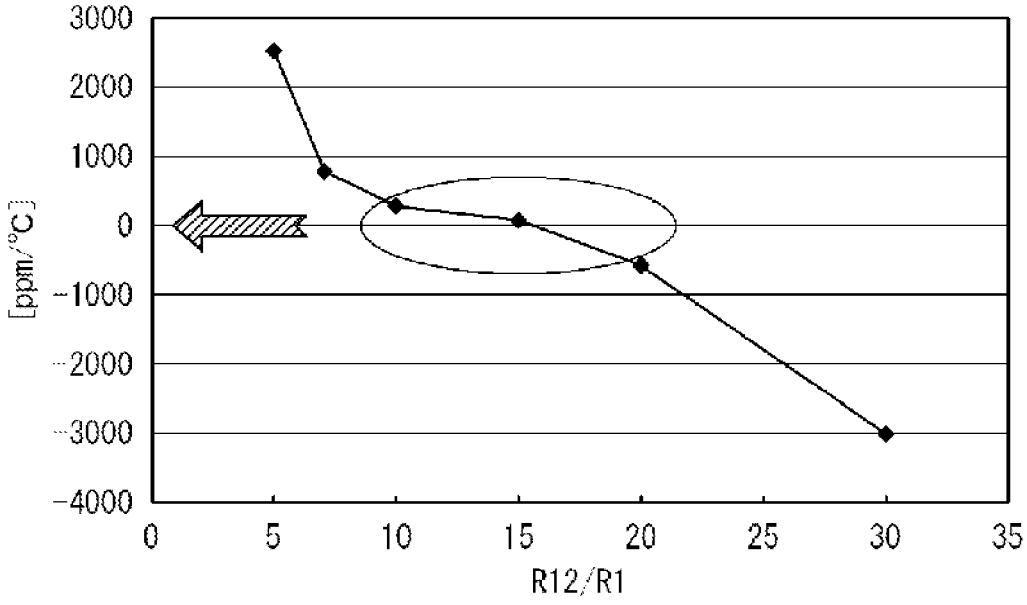
FIG. 3 is a diagram showing a temperature dependency of current based on a resistance ratio.
Figure 7:
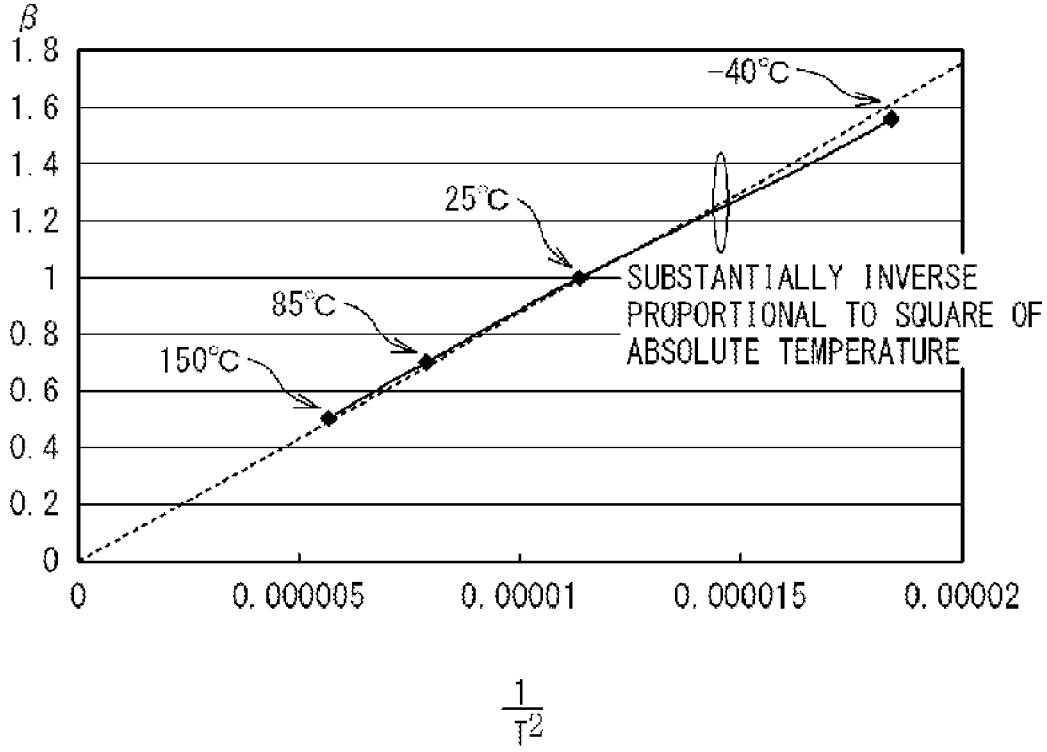
FIG. 7 is a diagram showing a temperature characteristic of conductance constant • of a transistor.

Moreover, the influence of the temperature can be reduced by adjusting resistance values $R_1$ and $R_{12}$ of the resistances R1 and R12. As shown in FIG. 7, the temperature characteristic of the conductance constant • of the transistor is substantially inversely proportional to the square of the absolute temperature T, but has a slight deviation from a linear line. The deviation can be corrected by a combination of a first and second term in the square term of the equation (7), and an optimum value can be obtained. That is, as shown in FIG. 3, when setting a resistance ratio $R_{12}/R_1$ to be 10 to 20, the temperature dependency of current becomes substantially 0 [ppm/° C.], and accordingly it can be understood that the temperature dependency of current can be reduced.

Moreover, in the current $I_{16}$ obtained by subtracting the current $I_{14}$ that is the mirror current of the current $I_2$, from the current $I_{15}$, the influence of the current $I_2$ included in the equation (7) is reduced. A factor of the variation of the current $I_2$ is based on the resistance R1, and the currents $I_2$ and $I_{15}$ vary in the same direction as that of the variation of the resistance R1. However, there is a difference between the degrees of variations of the currents, and accordingly, the influence of the variation of the resistance value $R_1$ of the resistance $R_1$ can be canceled. For example, as for the currents $I_2$ and $I_{15}$, examples of the variations of the current values when the resistance $R_1$ is higher and lower than a center value of the resistance $R_1$ are shown below. The variation of the current $I_2$:

(Resistance Value $R_1$ is Center Value)
$I_2$=1.04 [•A] (±0%),
(Resistance value $R_1$ is lower)
$I_2$=1.71 [•A] (+64.4%),
(Resistance value $R_1$ is higher)
$I_2$=0.63 [•A] (−39.4%)

The variation of the current $I_{15}$:

(Resistance Value $R_1$ is Center Value)
$I_{15}$=12.77 [•A] (±0%),
(Resistance value $R_1$ is lower)
$I_{15}$=14.53 [•A] (+13.8%),
(Resistance value $R_1$ is higher)
$I_{15}$=11.15 [•A] (−12.7%)

As described above, as for the currents $I_2$ and $I_{15}$, the current value becomes large when the resistance value $R_1$ of the resistance R1 is low, and the current value becomes small when the resistance value $R_1$ of the resistance R1 is high. Thus, the currents vary in the same direction. However, the degrees of and percentages of variations of the currents are different. This is based on the difference between the equation (5) and the equation (7).

Here, cases where the current $I_{14}$ is obtained by multiplying the current $I_2$ by 3.74 by the current mirror circuit and the current $I_{16}$ is obtained by subtracting the current $I_{14}$ from the current $I_{15}$ are shown below:

The variation of the current $I_{14}$:

(Resistance value $R_1$ is center value)
$I_{14}$=3.90[•A] (±0%),
(Resistance value $R_1$ is low)
$I_{14}$=6.40 [•A] (+64.4%),
(Resistance value $R_1$ is high)
$I_{14}$=2.36[•A] (−39.4%)

The variation of the current $I_{16}$:

(Resistance Value $R_1$ is Center Value)
$I_{16}$=8.77 [•A] (±0%),
(Resistance value $R_1$ is low)
$I_{16}$=8.13 [•A] (−7.3%),
(Resistance Value $R_1$ is High)
$I_{16}$=8.79 [•A] (+2.2%)

Figure 4:
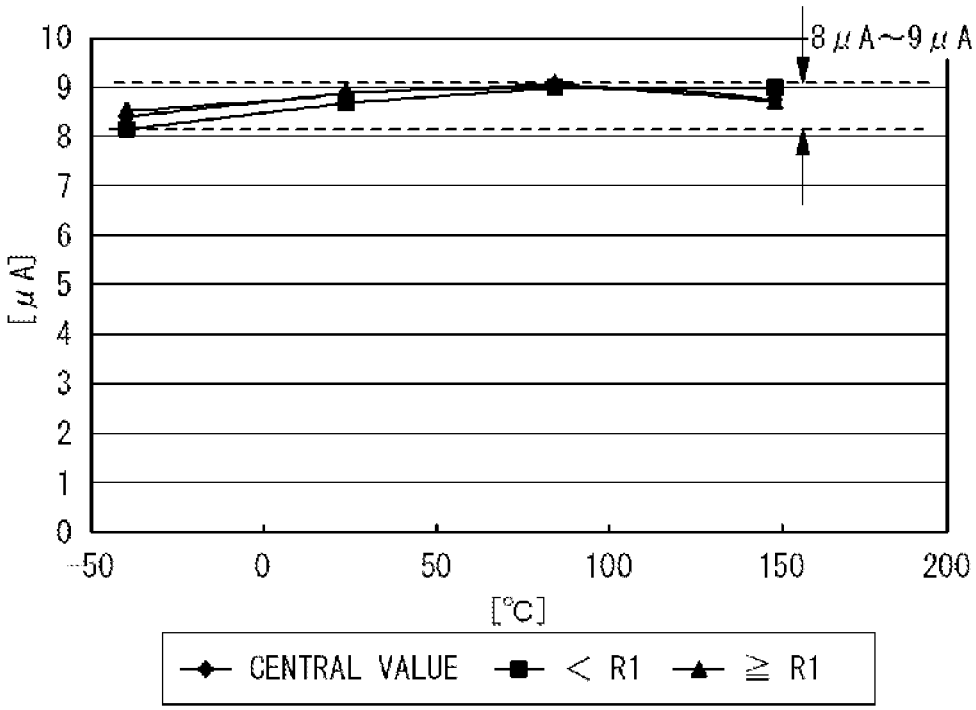
FIG. 4 is a diagram showing a variation of a current I16 due to a resistance R1.

Accordingly, as shown in FIG. 4, the current variation of the current $I_{16}$ due to the resistance $R_1$ becomes 8 [•A] to 9 [•A], and the influence of the current $I_2$, that is, the influence of the resistance $R_1$ can be reduced.

As described above, like the current $I_{16}$, the transistor P16 on the output-side of the current mirror circuit can output a stable current $I_{17}$ with respect to the temperature, power supply voltage, transistor threshold voltage, and resistance that are various variation factors. The current $I_{17}$ is obtained from the following equation (8):

$$I_{17} = I_{16} - nI_2 \tag{8}$$
$$= \frac{\beta}{2}\left(\frac{W_{14}}{L_{14}}\right)\left(\sqrt{\frac{I_2}{\frac{\beta}{2}\left(\frac{W_{13}}{L_{13}}\right)}} + \frac{R_{12}}{R_1}\frac{kT}{q}\ln(10)\right)^2 - nI_2$$

It should be noted that n=•$I_{16}$/•$I_{12}$ (n is set to 3.74 in the present embodiment.)

Since the basic current is changed from the basic current determined due to the resistance to the basic current determined due to the transistor, the stable current can be outputted due to the resistance that is not required to be proportional to the absolute temperature T. In addition, the influence of temperature can be reduced by adjusting the resistances $R_1$ and $R_{12}$. Moreover, as for the current variation due to the resistance value $R_1$, the influence of the resistance variation can be reduced by subtracting the current mirror current calculated based on n=•$I_6$/•$I_{12}$ from the basic current. In addition, since the circuit constant can be easily set and additionally the feedback is not employed, the stable correction can be carried out to the respective factors.

Second Embodiment

Figure 5:
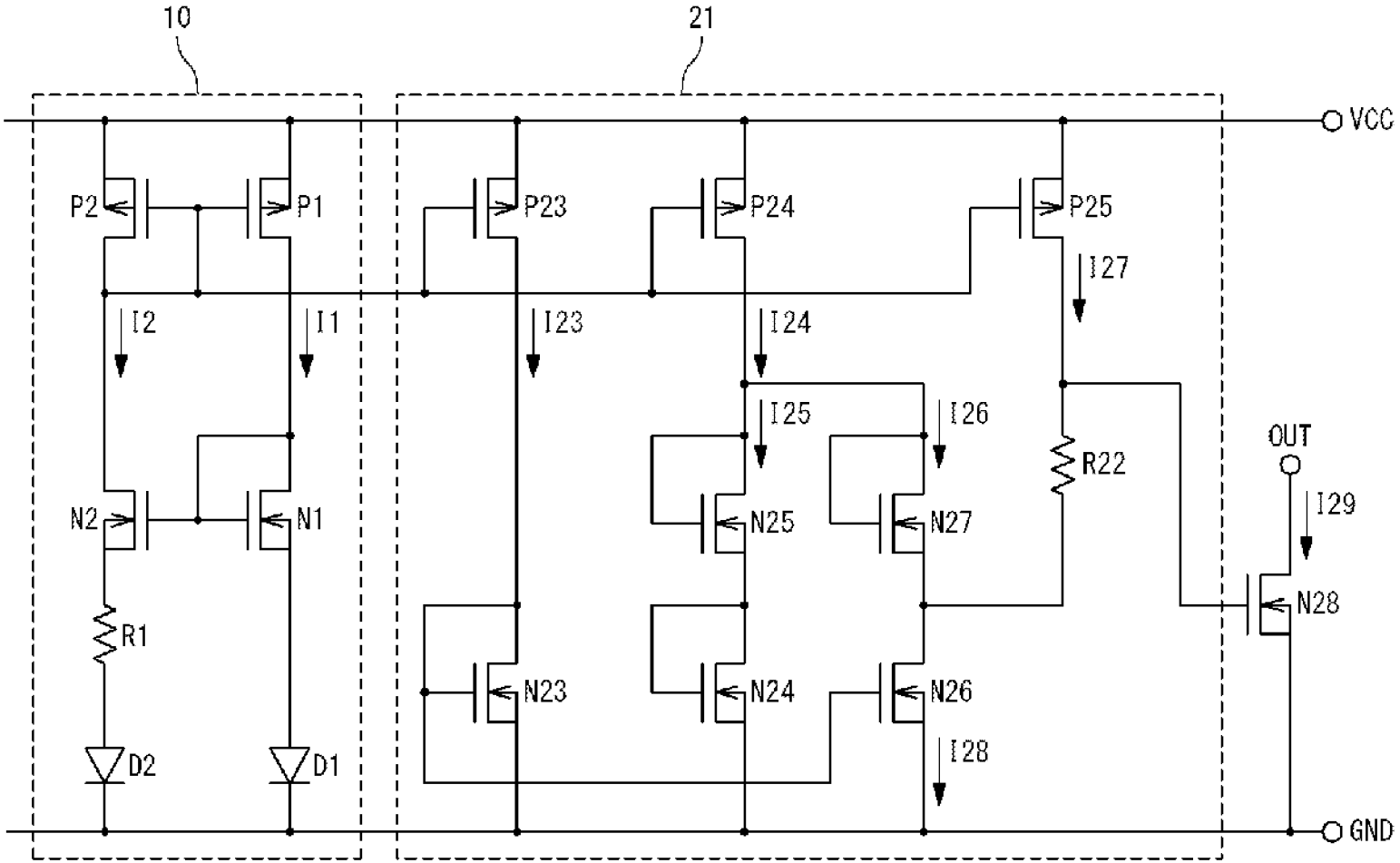
FIG. 5 is a circuit diagram showing a configuration of the current source circuit according to a second embodiment of the present invention.

FIG. 5 shows a configuration of the current source circuit according to a second embodiment of the present invention. The current source circuit includes the band gap reference circuit 10, a gate voltage generating circuit 21, and an output transistor N28. The band gap reference circuit 10 has the same configuration as that of the band gap reference circuit 10 of the current source circuit according to the first embodiment.

The band gap reference circuit 10 includes the P-channel MOS transistors P1 and P2, the N-channel MOS transistors N1 and N2, the resistance R1, and the diodes D1 and D2. The transistors P1 and P2 form the current mirror circuit. The commonly-connected gates are connected to the drain of the transistor P2. Thus, the transistor P2 serves as an input-side transistor and the transistor P1 serves as an output-side transistor. When the current mirror ratio of the current mirror circuit formed of the transistors P1 and P2 is 1:1, and when the current flowing through the transistor P1 is $I_1$ and the current flowing through the transistor P2 is $I_2$, $I_1$ is equal to $I_2$ ($I_1$=$I_2$).

The drain of the transistor P1 is connected to the drain of the transistor N1, and the drain of the transistor P2 is connected to the drain of the transistor N2. The transistors N1 and N2 form a current mirror circuit. The commonly-connected gates are connected to the drain of the transistor N1. Thus, the transistor N1 serves as an input-side transistor and the transistor N2 serves as an output-side transistor. The source of the transistor N1 is connected to the power supply voltage GND through the diode D1. The source of the transistor N2 is connected to the power supply voltage GND through the resistance $R_1$ and diode D2 that are connected in series. The area ratio of diodes D1 and D2 is set to 1:10.

The gate voltage generating circuit 21 includes P-channel MOS transistors P23, P24, and P25, N-channel MOS transistors N23, N24, N25, N26, and N27, and a resistance $R_{22}$. The output transistor N28 is an N-channel MOS transistor.

The transistors P23, P24, and P25 have sources connected to the power supply voltage Vcc, and gates connected to the gate and drain of the transistor P2 of the band gap reference circuit 10, and serve as the output-side transistors of the current mirror circuit using the transistor P2 as the input-side transistor. The current mirror ratio of the transistors P2, P23, P24, and P25 is 1:1:5:1. The drain of the transistor P23 is connected to the power supply voltage GND through the transistor N23. A gate and a drain in the transistor N23 are connected to each other and further connected to a gate of the transistor N26. The transistor N23 serves as the input-side transistor of the current mirror circuit. A current $I_{23}$ flows through the transistor N23. The drain of the transistor P24 is connected to the power supply voltage GND through the diode-connected transistors N25 and N24 connected in series. A current $I_{24}$ flows through the transistor P24, and a current $I_{25}$ flows through the transistors N25 and N24.

The drain of the transistor P24 is further connected to the power supply voltage GND through the diode-connected transistor N27 and the transistor N26 that is the output-side transistor of the current mirror circuit. A current ratio of the current mirror circuit including the transistor N23 and the transistor N26 is 1:5, and a current $I_{28}$ flows through the transistor N26. The current $I_{26}$ flows through the transistor N27. A resistance $R_{22}$ is connected between a connection node between the transistor N27 and transistor N26 and the drain of the transistor P25, and thus a current $I_{27}$ flows through the transistor P25. A connection node between the transistor P25 and the resistance R22 is connected to the gate of the output transistor N28. The output transistor N28 is connected between the output node OUT and the power supply voltage GND, and thus a current $I_{29}$ flows.

An operation of the current source circuit will be described. In the band gap reference circuit 10, the area ratio of the diodes D1 and D2 is set to 1:10, and the current mirror ratio of the transistors P1 and P2 is set to 1:1, and the transistors N1 and N2 are set to the same size. In this case, when the voltage drops due to the diodes D1 and D2 are $V_{D1}$ and $V_{D2}$, the voltage drop $V_{R1}$ due to the resistance $R_1$ is obtained from the following equation (9):

$$V_{R1} = V_{D1} - V_{D2} \tag{9}$$
$$= \frac{kT}{q}\ln\left(\frac{I_1}{I_{S1}}\right) - \frac{kT}{q}\ln\left(\frac{I_2}{I_{S2}}\right)$$
$$= \frac{kT}{q}\ln\left(\frac{I_1}{I_2}\frac{I_{S2}}{I_{S1}}\right) = \frac{kT}{q}\ln(10)$$

where $V_{R1}$ is the voltage drop due to the resistance $R_1$, $V_{D1}$ is the voltage drop due to the diode D1, $V_{D2}$ is the voltage drop due to the diode D2, $I_{S1}$ is an inverse direction saturation current of the diode D1, $I_{S2}$ is an inverse direction saturation current of the diode D2, the current mirror ratio of the transistors P1 and P2 is 1:1 ($I_1$/$I_2$=1), and the diode area ratio is 1:10 ($I_{S2}$/$I_{S1}$=10).

Accordingly, the current I2 is obtained from the following equation (10):

$$I_2 = \frac{V_{R1}}{R_1} = \frac{kT}{qR_1}\ln(10) \tag{10}$$

The currents $I_1$, $I_2$, $I_{23}$, and $I_{27}$ having the same current value as that of the current $I_2$ flow through the transistors P1, P2, P23, and P25 constituting the current mirror circuit. Specifically, the following equation is satisfied, $$I_1=I_2=I_{23}=I_{27}.$$

The gate voltage generating circuit 21 includes a P-channel current mirror circuit using the transistors P2, and the transistors P23, P24, and P25 as the output-side transistor, and the current ratio is 1:1:5:1. In addition, the gate voltage generating circuit 21 includes an N-channel current mirror circuit using the transistor N23 as the input-side transistor, and the transistor N26 as the output-side transistor. The current ratio is 1:5. Accordingly, the current ratio of the currents $I_{24}$ to $I_{28}$ is "$I_{24}$:$I_{25}$:$I_{26}$:$I_{27}$:$I_{28}$=5:1:4:1:5".

When the transistors N24, N25, and N27 are transistors having a same size, voltage drops $V_{N24}$, $V_{N25}$, and $V_{N27}$ due to the respective transistors are shown in the following equations (11):

$$V_{N24} = V_{N25} = \sqrt{\frac{I_{25}}{\frac{\beta}{2}\left(\frac{W_{24}}{L_{24}}\right)}} + V_{tn} \tag{11}$$

$$\begin{aligned} V_{N27} &= \sqrt{\frac{I_{26}}{\frac{\beta}{2}\left(\frac{W_{27}}{L_{27}}\right)}} + V_{tn} \\ &= \sqrt{\frac{4I_{25}}{\frac{\beta}{2}\left(\frac{W_{27}}{L_{27}}\right)}} + V_{tn} \\ &= 2\sqrt{\frac{I_{25}}{\frac{\beta}{2}\left(\frac{W_{24}}{L_{24}}\right)}} + V_{tn} \end{aligned}$$

where W24 is a gate width of the transistor N24, L24 is a gate length of the transistor N24, W27 is a gate width of the transistor N27, and L27 is a gate length of the transistor N27.

Accordingly, a voltage drop (a drain-source voltage) $V_{N26}$ of the transistor N26 becomes equal to the threshold voltage Vtn of the transistor from the following equations (12):

$$\begin{aligned} V_{N26} &= V_{N24} + V_{N25} - V_{N27} \\ &= \sqrt{\frac{I_{25}}{\frac{\beta}{2}\left(\frac{W_{24}}{L_{24}}\right)}} + V_{tn} + \sqrt{\frac{I_{25}}{\frac{\beta}{2}\left(\frac{W_{24}}{L_{24}}\right)}} + V_{tn} - \\ &\quad \left(2\sqrt{\frac{I_{25}}{\frac{\beta}{2}\left(\frac{W_{24}}{L_{24}}\right)}} + V_{tn}\right) \\ &= V_{tn} \end{aligned} \tag{12}$$

In addition, since the current $I_{27}$ has the current value $I_2$ that is the same as that of the current $I_2$, a voltage drop $V_{R22}$ due to the resistance $R_{22}$ is shown by equation (13) as follows. As could be understood from the following equation (13), the voltage drop $V_{R22}$ due to the resistance $R_{22}$ is proportional to the thermal voltage:

$$V_{R22} = I_{27} \times R_{22} = I_2 \times R_{22} = \frac{R_{22}}{R_1}\frac{kT}{q}\ln(10) \tag{13}$$

A voltage $V_{G6}$ that is the summation of the drain-source voltage $V_{N26}$ (=Vtn) of the transistor N26, and the voltage drop $V_{R22}$ due to the resistance $R_{22}$ is applied to the gate of the output transistor N28 as shown in the following equation (14):

$$V_{G6} = V_{N26} + V_{R22} = V_{tn} + \frac{R_{22}}{R_1}\frac{kT}{q}\ln(10) \tag{14}$$

Specifically, the current $I_{29}$ flowing through the output transistor N28 is shown in the following equation (15):

$$\begin{aligned} I_{29} &= \frac{\beta}{2}\left(\frac{W_{28}}{L_{28}}\right)\left(V_{tn} + \frac{R_{22}}{R_1}\frac{kT}{q}\ln(10) - V_{tn}\right)^2 \\ &= \frac{\beta}{2}\left(\frac{W_{28}}{L_{28}}\right)\left(\frac{R_{22}}{R_1}\frac{kT}{q}\ln(10)\right)^2 \end{aligned} \tag{15}$$

where $W_{28}$ is a gate width of the transistor N28, and $L_{28}$ is a gate length of the transistor N28.

In the above equation (15), the threshold voltage Vtn of the N-channel transistor and the power supply voltage VCC are not included. Accordingly, the current $I_{29}$ becomes a stable current without being influenced by the threshold voltage variation of the transistor and the power supply voltage variation of circuit.

In addition, the overdrive voltage in the equation (15) is proportional to the absolute temperature T as shown by the following equation (16):

$$\frac{R_{22}}{R_1}\frac{kT}{q}\ln(10) \tag{16}$$

Figure 6:
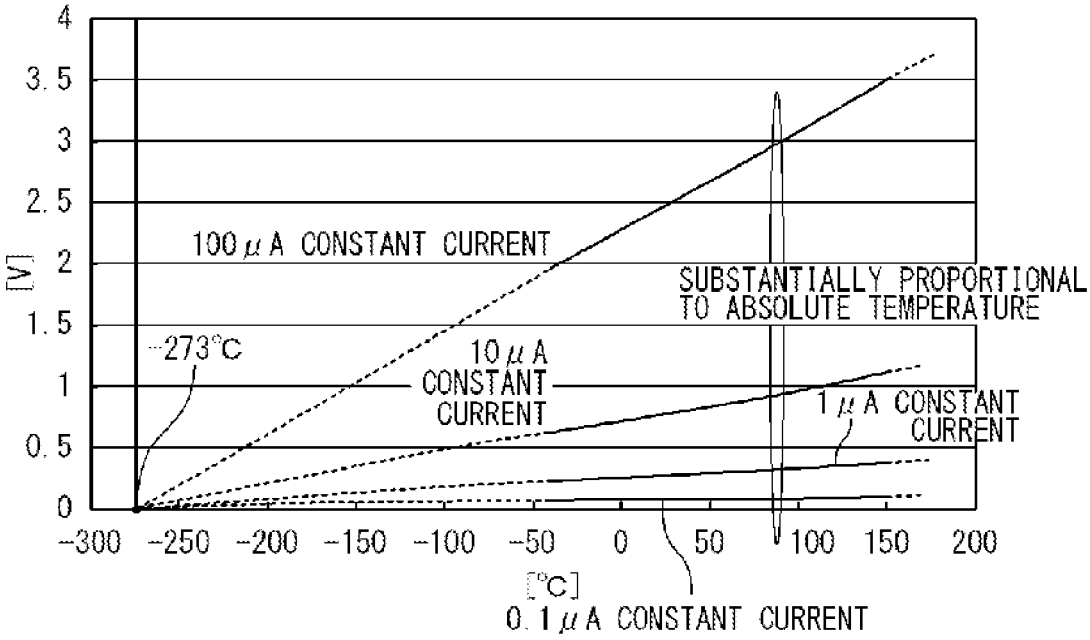
FIG. 6 is a diagram showing a temperature dependency of over-drive voltage.

As shown in FIG. 6, when the overdrive voltage is proportional to the temperature T, the drain current of the transistor does not almost depend on the temperature. FIG. 6 shows overdrive voltage characteristics when constant currents in a range from 0.1 [•A] to 100 [•A] flow through the transistor. It could be understood that the respective characteristics show the overdrive voltage proportional to the absolute temperature starting from the absolute zero temperature, that is, 0 [V] at −273 [° C.].

As shown in FIG. 7, this is because since the conductance constant • of the transistor is substantially inversely proportional to the square of the temperature T, the absolute temperature T is canceled as a result. In the graph, the horizontal axis is $1/T^2$, and the graph is normalized such that the conductance constant • is 1.0 at 25 [° C.]. The substantially proportional relation is shown on the graph, and it could be understood that the value of the conductance constant • is inversely proportional to the square of the absolute temperature T. Accordingly, the current $I_{29}$ shown by the equation (15) does not almost have the temperature dependency. Moreover, since the variations of the resistances $R_1$ and $R_{22}$ are canceled by the resistance ratio, the current $I_{29}$ is not influenced by the resistance variation. Thus, the output transistor N28 outputs the stable current $I_{29}$ with respect to variations of the temperature, the power supply voltage, the transistor threshold voltage, and the resistance.

Since the basic current is changed from the basic current determined due to the resistance to the basic current determined due to the transistor, the stable current can be outputted due to the resistance that is not required to be proportional to the absolute temperature T. In addition, the influence of the temperature can be reduced by applying the voltage proportional to the temperature T as the overdrive voltage. Moreover, by accurately producing the threshold voltage of the transistor, the influence of the resistance variation can be reduced. In addition, since circuit constants can be easily set and additionally the feedback is not employed, the stable correction can be carried out to the respective elements.

As described above, although the number of elements is slightly increased in comparison with the current source circuit according to the first embodiment, the current source circuit according the present embodiment does not require to calculate and set the resistance ratio to reduce the temperature dependency and the current mirror ratio for reducing the influences of the resistance variation due to the transistor characteristic and the resistance characteristic, thereby being able to configure the circuit more easily.

According to the present invention, the stable current can be supplied by a simple circuit configuration with respect to the process variation, the power supply variation, and the temperature variation in the semiconductor integrated circuit.

As described above, the present invention has been described referring to the embodiments. However, the present invention is not limited to the above-described embodiments. It could be understood by a person skilled in the art that various modifications applied to the configurations of the present invention fall within the scope of the present invention.

The following terms are shown relating to the above-mentioned description.

(Term 1) A current source circuit includes:

a reference current source circuit configured to generate a reference current based on a first power supply voltage and a second power supply voltage;

a reference voltage source circuit configured to generate a voltage proportional to a thermal voltage based on the reference current;

a threshold voltage output circuit configured to output a threshold voltage of a first conductive type transistor based on the reference current; and a first transistor of the first conductive type to which a voltage as addition of a voltage generated by the reference voltage source circuit and the threshold voltage outputted from the threshold voltage output circuit is applied to a gate of the first transistor, to supply a predetermined output current.

(Term 2) The current source circuit according to term 1, wherein the reference voltage source circuit includes:

a second transistor of a second conductive type complementary to the first conductive type through which a first current flows based on the reference current; and a first resistance configured to output a voltage drop generated by the flow of the first current as a voltage proportional to the thermal voltage.

(Term 3) The current source circuit according to term 1, wherein the threshold voltage output circuit includes:

a third transistor of the second conductive type configured to generate a second current based on the reference voltage;

a fourth transistor of the second conductive type configured to generate a third current based on the reference current;

a fifth and sixth transistor of the conductive type that are connected in series, in which the fifth transistor and a sixth transistor are connected in a diode-connection to flow a fourth current;

a seventh and eighth transistor of the first conductive type which are connected in series, in which the seventh transistor is connected in the diode connection to flow a fifth current; and a ninth transistor connected between the third transistor and the second power supply voltage, in which the ninth transistor is connected in the diode connection to form a current mirror circuit with the eighth transistor, and to flow a sixth current based on the second current through the eighth transistor;

wherein the fifth transistor and the sixth transistor, and the seventh transistor and the eighth transistor are connected in parallel between the fourth transistor and the second power supply voltage.

(Term 4) The current source circuit according to term 3, wherein a ratio of current values of the first current, the third current, the fourth current, the fifth current, and the sixth current is 1:5:4:1:5.

(Term 5) The current source circuit according to term 1, wherein the reference current source circuit is a band gap reference circuit which includes:

a tenth transistor and an eleventh transistor of the first conductive type, in which gates of the tenth transistor and the eleventh transistor are connected to a drain of the tenth transistor to form a current mirror circuit;

a twelfth and thirteenth transistor of the second conductive type, in which gates of the twelfth transistor and the thirteenth transistor are connected to a drain of the thirteenth transistor to form the current mirror circuit;

a first diode and a second diode; and a second resistance, wherein the twelfth transistor, the tenth transistor, and the first diode are connected in series between the first power supply voltage and the second power supply voltage, and wherein the thirteenth transistor, the eleventh transistor, and the second resistance, and the second diode are connected in series between the first power supply voltage and the second power supply voltage.

(Term 6) A current source circuit includes:

a reference current source circuit which includes:

a first and second transistor of a first conductive type, in which gates of the first transistor and the second transistor are connected to a drain of the first transistor to form a current mirror circuit;

a third transistor and a fourth transistor of a second conductive type mutually complementary with the first conductive type, gates of the third transistor and the fourth transistor being connected to a drain of the fourth transistor to form a current mirror circuit;

a first diode and a second diode; and a first resistance, wherein the third transistor, the first transistor, and the first diode are connected in series between the first power supply voltage and the second power supply voltage, and wherein the fourth transistor, the second transistor, the first resistance, and the second diode are connected in series between the first power supply voltage and the second power supply voltage, and the reference current source circuit outputs a drain voltage of the fourth transistor to an output-side transistor of the current mirror circuit by using the current flowing through the fourth transistor as a reference current;

a reference voltage source circuit which includes:

a fifth transistor of the second conductive type that forms a current mirror circuit with the fourth transistor, in which a drain voltage is applied to a gate, and through which a first current flows based on the reference current; and a second resistance for outputting a voltage drop generated by flow of the first current as a voltage proportional to a thermal voltage;

a threshold voltage output circuit having:

a sixth transistor of the second conductive type for generating a second current based on the reference current;

a seventh transistor of the second conductive type for generating a third current based on the reference current;

an eighth transistor and a ninth transistor of the first conductive type to be connected in series, the eighth transistor and the ninth transistor being connected in a diode-connection to flow a fourth current;

a tenth transistor and an eleventh transistor of the first conductive type to be connected in series, the tenth transistor being connected in the diode connection to flow a fifth current; and a twelfth transistor connected between the sixth transistor and the second power supply voltage, the twelfth transistor being connected in the diode connection to form a current mirror circuit with the eleventh transistor, and to flow a sixth current based on the second current in the eleventh transistor, wherein the eighth transistor and the ninth transistor, and the tenth transistor and the eleventh transistor are connected in parallel between the seventh transistor and the second power supply voltage, for outputting a drain-source voltage of the eleventh transistor as a threshold voltage of the transistor of the first conductive type, and wherein an output transistor of the first conductive type to which a voltage obtained by adding the voltage generated by the reference voltage source circuit and the threshold voltage outputted from the threshold voltage output circuit is applied, for supplying a predetermined output current.

(Term 7) The current source circuit according to term 6, wherein a ratio of current values of the first current, the third current, the fourth current, the fifth current, and the sixth current is 1:5:4:1:5.

(Term 8) A semiconductor device integrating the current source circuit according to term 1.

(Term 9) A semiconductor device integrating the current source circuit according to term 6.

What is claimed is:

1. A current source circuit comprising:

a reference current source circuit configured to generate a reference current based on a first power supply voltage and a second power supply voltage;

a reference voltage source circuit configured to generate a voltage proportional to a thermal voltage based on said reference current;

a first transistor of a first conductive type which is connected between said reference voltage source circuit and said second power supply voltage and through which a first current flows;

a second transistor of the first conductive type which has a gate applied with a voltage as a result of addition of the voltage generated by said reference voltage source circuit and a voltage between a source and a drain of said first transistor and through which a second current flows;

a current source configured to supply a third current of a current value proportional to that of said first current; and a third transistor of a second conductive type complimentary to the first conductive type, wherein a difference current between said second current and said third current flows through said third transistor, wherein an output current is supplied based on said difference current.

2. The current source circuit according to claim 1, wherein said reference voltage source circuit comprises:

a fourth transistor of the second conductive type through which said first current flows based on said reference current; and a first resistance configured to output a voltage drop which is generated with said first current as a voltage proportional to said thermal voltage.

3. The current source circuit according to claim 1, wherein said current source comprises:

a fifth transistor of the second conductive type configured to supply said third current based on said reference current.

4. The current source circuit according to claim 1, further comprising:

a sixth transistor of the second conductive type which forms a current mirror circuit together with said third transistor, wherein a gate and a drain of said third transistor are connected, and said sixth transistor supplies the output current based on said difference current.

5. The current source circuit according to claim 1, wherein said reference current source circuit comprises a band gap reference circuit which comprises:

a seventh and eighth transistor of the first conductive type, wherein gates of said seventh and eighth transistors are connected with a drain of said seventh transistor to form a current mirror circuit;

a ninth and tenth transistor of the second conductive type, wherein gates of said ninth and tenth transistors are connected with a drain of said tenth transistor to form a current mirror circuit;

a first diode and a second diode; and a second resistance, wherein said ninth transistor, said seventh transistor, and said first diode are connected in series between said first power supply voltage and said second power supply voltage, and wherein said tenth transistor, said eighth transistor, said second resistance, and said second diode are connected in series between said first power supply voltage and said second power supply voltage.

6. A semiconductor device comprises a current source circuit according to claim 1.

7. A current source circuit comprising:

a reference current source circuit which comprises:

a first and second transistor of a first conductive type, wherein gates of said first and second transistors are connected with a drain of said first transistor to form a current mirror circuit, a third and fourth transistor of a second conductive type complementary to the first conductive type, wherein gates of said third and fourth transistors are connected with a drain of said fourth transistor to form a current mirror circuit, a first and second diode, and a first resistance;

wherein a said third transistor, said first transistor, and said first diode are connected in series between a first power supply voltage and a second power supply voltage;

wherein said fourth transistor, said second transistor, said first resistance, and said second diode are connected in series between said first power supply voltage and said second power supply voltage;

wherein a drain voltage of said fourth transistor is outputted to an output-side transistor of said current mirror circuit by using a current flowing through said fourth transistor as a reference current;

a reference voltage source circuit which comprises:

a fifth transistor of said second conductive type which forms a current mirror circuit together with said fourth transistor, wherein a drain voltage of said fourth transistor is applied to a gate of said fifth transistor, and a first current flows based on said reference current, a second resistance configured to output a voltage drop generated based on said first current as a voltage proportional to a thermal voltage, a sixth transistor of the first conductive type which is connected between said reference voltage source circuit and said second power supply voltage and through which said first current flows, a seventh transistor of the first conductive type which a voltage equal to a summation of a voltage generated by said reference voltage source circuit and a voltage between a source and a drain in said sixth transistor is applied to a gate of said seventh transistor through which a second current flows, an eighth transistor of the second conductive type which forms a current mirror circuit together with said fourth transistor, in which a drain voltage of said fourth transistor is applied to a gate of said eighth transistor, and which supplies a third current of a current value which is proportional to said first current based on said reference current, and a ninth transistor of the second conductive type through which a difference current between said second current and said third current flows, and in which a gate and a drain are connected; and an output transistor of the second conductive type which forms a current mirror circuit together with said ninth transistor and which supplies an output current based on said difference current.

8. A semiconductor device comprises a current source circuit according to claim 7.

* * * * *